United States Patent [19]

Schmoyer

[11] Patent Number: 4,794,825

[45] Date of Patent: Jan. 3, 1989

[54] HYDRAULIC POWER WRENCH

[75] Inventor: Harold J. Schmoyer, Spring, Tex.

[73] Assignee: Atlantic-Caribbean Products, Inc.

[21] Appl. No.: 140,978

[22] Filed: Jan. 5, 1988

Related U.S. Application Data

[63] Continuation of Ser. No. 926,457, Nov. 3, 1986, abandoned.

[51] Int. Cl.[4] ..... B25B 13/46

[52] U.S. Cl. ..... 81/57.39; 81/57.24; 81/57.4

[58] Field of Search ..... 81/57.39, 57.24, 57.4, 81/57.60, 57.61, 57.35

[56] References Cited

U.S. PATENT DOCUMENTS

| | | | |
|---|---|---|---|
| 2,491,624 | 12/1949 | Shaff | 81/57.39 |
| 4,079,641 | 3/1978 | Junkers | 81/57.39 |
| 4,200,011 | 4/1980 | Wilmeth | 81/57.39 |
| 4,201,099 | 5/1980 | Junkers | 81/57.39 |
| 4,233,865 | 11/1980 | Junkers | 81/57.44 |
| 4,336,727 | 6/1982 | Junkers | 81/57.39 |
| 4,368,655 | 1/1983 | Junkers | 81/57.39 |
| 4,372,181 | 2/1983 | Tinsley | 81/57.39 |
| 4,423,649 | 1/1984 | Junkers et al. | 81/57.39 |
| 4,440,046 | 4/1984 | Hirtsiefer et al. | 81/57.39 |
| 4,458,563 | 7/1984 | Bickford et al. | 81/57.39 |
| 4,480,510 | 11/1984 | Aparicio et al. | 81/57.39 |
| 4,513,644 | 4/1985 | Weyer | 81/57.39 |
| 4,607,546 | 8/1986 | Wagner | 81/57.39 |

*Primary Examiner*—Frederick R. Schmidt
*Assistant Examiner*—Lawrence Cruz
*Attorney, Agent, or Firm*—Hubbard, Thurman, Turner & Tucker

[57] ABSTRACT

A split roller block assembly is interposed and captively retained between facing surfaces of the drive pin and drive piston rod disposed within the housing of a hydraulic power wrench. The assembly smoothly couples these two elements to substantially strengthen the interconnection therebetween to increase the useful life of the wrench. The wrench is additionally provided with a reaction arm portion which is removably connectable to the wrench housing in a multiplicity of rotational orientations relative thereto, the reaction arm being rotationally locked to the housing in each such orientation. Reverse rotation of the drive shaft portion of the wrench is precluded by a safety pawl and ratchet system mounted externally on the wrench housing. The safety system may be manually disengaged to permit such reverse shaft rotation in the event that the maximum wind-up force on a threaded fastener being tightened by the wrench occurs while the piston rod is in an intermediate position of its forward power stroke and the reaction arm is locked against an adjacent support surface. This permits the housing to be pivoted relative to the drive shaft to disengage the reaction arm from the support surface so that the wrench can be easily disengaged from the threaded fastener.

27 Claims, 4 Drawing Sheets

HYDRAULIC POWER WRENCH

This application is a continuation of application Ser. No. 926,457, filed Nov. 3, 1986, abandoned.

BACKGROUND OF THE INVENTION

The present invention relates generally to power tools, and more particularly provides an improved hydraulic power wrench for tightening and loosening threaded fasteners such as nuts or bolts.

As exemplified in U.S. Pat. Nos. 4,201,099; 4,336,727; 4,423,649; 4,233,865; 4,368,655; and 4,513,644, a variety of hydraulically powered wrench designs have been previously proposed for the transmission of rotational power to threaded fasteners. A common constructional theme has been to provide a hydraulically driven piston within the wrench housing and to utilize the translational piston motion to rotationally drive an output shaft carried by the housing and connectable to a threaded fastener to be tightened or loosened. This linear-to-rotational motion conversion is typically accomplished by positioning a drive element, such as a pin member, between the piston and the shaft, and interconnecting the drive member between the piston and output shaft with suitable pivotal linkage members.

A drive ratchet locked to the output shaft within the housing is rotationally driven in a first direction, by a pawl carried by the linkage members between the drive member and shaft, during the forward power stroke of the piston and drive member. During the rearward return stroke of the piston and drive member, reverse rotation of the output shaft is precluded by a second ratchet and pawl mechanism disposed within the wrench housing.

As the threaded fastener is being tightened by the wrench, it is a common practice to brace a portion of the housing against a suitable adjacent support surface to prevent undesirable reactive rotation of the housing about the output shaft. This bracing technique is often facilitated by the provision of a reaction brace plate or arm member secured to the housing in a spaced relation with the output shaft and adapted to engage the adjacent support surface.

In theory at least, power wrenches of this general design are well suited to provide a predetermined amount of torque to threaded fasteners in a variety of applications requiring a heavy duty tool able to withstand often harsh environments, rough handling and high internal and external forces. In practice, however, such wrenches have proven to be subject to premature mechanical failure as well as having various operational limitations associated therewith.

A key mechanical failure point in such wrenches has been in the linkage region between the piston and the internal drive pin. Conventional interconnecting means used in this critical area have simply not been of sufficient strength, durability and ruggedness to suitably withstand the large hydraulic forces transmitted to the drive pin via the piston during its power stroke. Such linkage has been subject to premature failure or breakage and/or has been prone to cause premature and excessive wearing of the drive pin.

Another limitation commonly associated with hydraulic power wrenches of this type is related to their inaccessably disposed internal anti-reverse pawl and ratchet mechanism which prevents reverse rotation of the output shaft during the return stroke of the piston. If the maximum wind-up force on the fastener being tightened occurs while the piston is at some intermediate position of its power stroke, this mechanism can lock the entire drive mechanism of the wrench with the wrench housing being very tightly braced against its adjacent support surface. This can make it very difficult to remove the wrench from the fastener and the support surface, and can cause undesirable equipment downtime.

The bracing structures conventionally used in power wrenches of this type give rise to yet another operational limitation in that they are either fixed in a single position to the wrench housing or are positionally adjustable relative to the housing only to a very limited degree. This, of course, limits the usefulness of the bracing structure where adjacent support surfaces are not suitably positioned to be engaged by such structure.

It can be seen from the foregoing that a need exists for an improved hydraulic power wrench which eliminates or minimizes the above-mentioned and other limitations and disadvantages commonly associated with power wrenches of conventional design. It is accordingly an object of the present invention to provide such a wrench.

SUMMARY OF THE INVENTION

In carrying out principles of the present invention, in accordance with a preferred embodiment thereof, an improved hydraulic power wrench is provided which comprises a housing having a chamber formed therein that receives piston means hydraulically drivable between first and second positions, a drive pin carried within the housing in a spaced relation with the piston means, and a drive shaft rotatably carried by the housing and extending therethrough. Linkage means are provided which are pivotally interconnected between the drive pin and the piston means, and between the drive pin and the drive shaft. A drive ratchet member is positioned within the housing and rotationally locked to the drive shaft.

During the forward power stroke of the piston means, the ratchet member is incrementally driven in a first rotational direction by drive pawl means fixedly secured to the drive pin for rotation therewith and biased into engagement with the ratchet member by spring means interconnected between the drive pin and the portion of the linkage means interconnected between the drive pin and the drive shaft. The spring means automatically cause rotation of the drive pin to bring the pawl means into operative engagement with the ratchet member during the power stroke of the piston means, and to pivot the pawl means out of operative engagement with the ratchet member during the return stroke of the piston means.

Reverse rotation of the drive shaft during the return stroke of the piston means is prevented by safety ratchet and pawl means uniquely mounted externally on the housing. Means are provided for manually inactivating these safety pawl and ratchet means to selectively permit reverse rotation of the drive shaft relative to the housing. In the event that the maximum wind-up force on a threaded fastener being tightened by the wrench occurs while the piston means are in an intermediate position of their power stroke, this important feature of the present invention allows the housing to be pivoted relative to the drive shaft to easily and rapidly unlock the housing from a support surface against which is braced.

According to another important aspect of the present invention, the conventionally rather weak and failure-prone interconnection between the piston means and the drive pin is substantially strengthened by the provision of uniquely configured roller means which are interposed between and engage facing surfaces of the piston means and the drive pin. In a preferred embodiment thereof, the roller means comprise roller bracket means, a first roller member captively retained in the roller bracket means for rotation relative thereto and having a side surface portion which engages a surface portion of the piston means, and second and third roller members captively retained in the roller bracket means for rotation relative thereto and having side surface portions which engage the drive pin on circumferentially spaced side surface portions thereof. The roller means are captively retained between the piston means and the drive pin by the portion of the linkage means pivotally interconnected between the piston means and the drive pin.

In accordance with another feature of the present invention, reaction arm means are provided which are uniquely connectable to the wrench housing in a multiplicity of rotational orientations relative thereto, in each of such positions the reaction arms means being rotationally locked to the housing. Because of this reaction arm adjustment feature, the operational flexibility of the wrench is significantly enhanced since the reaction arm may be braced against a much wider variety of support surfaces adjacent the threaded fastener being torqued by the wrench.

In a preferred embodiment thereof, the reaction arm means comprise a hollow cylindrical body portion having a circumferentially spaced series of axially extending interior surface grooves, and a reaction arm portion projecting laterally outwardly from the body portion. A rear or support portion of the wrench housing is of a cylindrical configuration and has formed thereon a circumferentially spaced series of longitudinally extending external splines. The reaction arm means may be easily and quickly connected to the wrench housing, in a selected one of many rotational orientations relative thereto, by simply axially inserting the housing support portion into the reaction arm body portion so that the housing splines are received in the body grooves. The body may be conveniently retained on the housing by means of a small set screw which extends radially through the reaction arm body and bears against the housing support portion.

DETAILED DESCRIPTION

Figure 1:
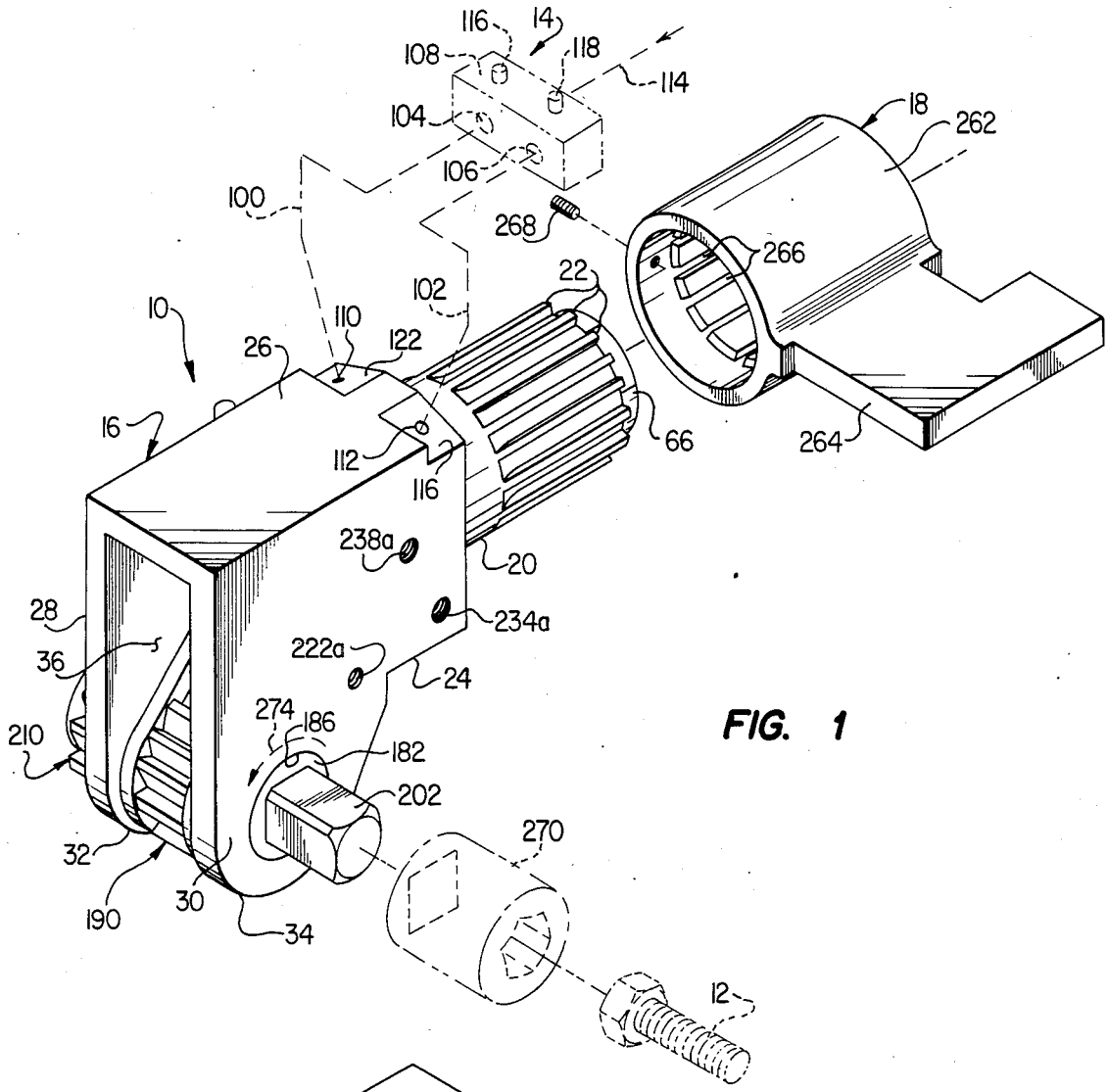
FIG. 1 is a partially exploded left side perspective view of an improved hydraulic power wrench which embodies principles of the present invention, the hydraulic supply system used to power the wrench being schematically depicted in phantom.
Figure 2:
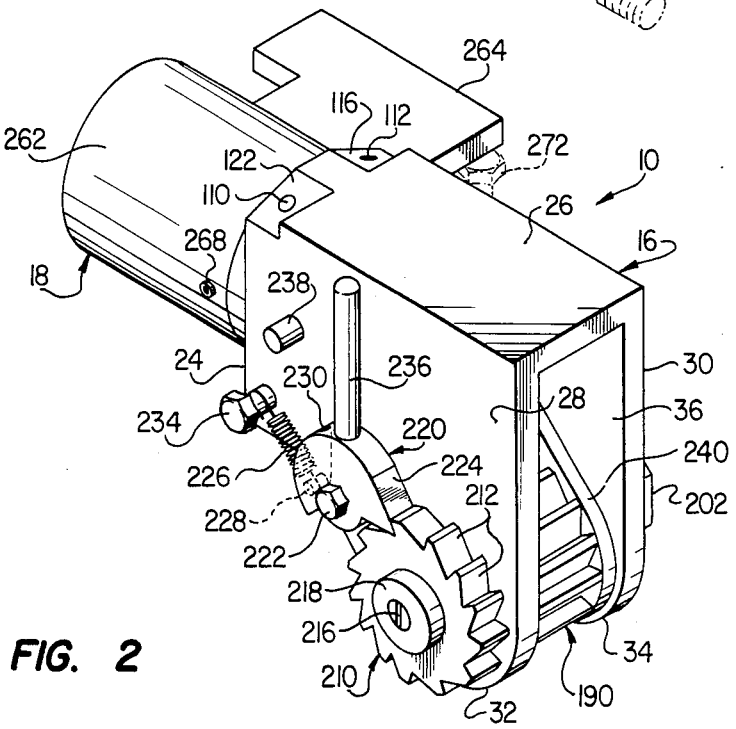
FIG. 2 is a right side perspective view of the wrench with the hydraulic supply system removed therefrom.

Perspectively illustrated in FIGS. 1 and 2 is an improved hydraulic power wrench 10 which embodies principles of the present invention and is utilized to transmit rotational power to a threaded fastener, such as bolt 12, to tighten or loosen such fastener. Wrench 10 is driven by a schematically depicted hydraulic power system 14 and includes a one piece heattreated steel housing 16 and a reaction arm member 18 removably connectable to the housing in a manner subsequently described.

Referring now to FIGS. 1, 2, 3A and 4, the housing 16 has a cylindrical rear portion 20 having a circumferentially spaced series of axially extending external splines 22 formed thereon, a central portion 24 having a generally rectangular cross-section, and a front portion defined by an upper wall 26 extending forwardly from the upper end of housing portion 24, and a pair of mutually spaced sidewalls 28, 30 which depend from opposite side edge portions of the top wall 26 and have curved lower ends 32 and 34, respectively. The sidewalls 28, 30 define within the front portion of the housing 16 a cavity 36 which opens outwardly through the front and lower ends of the front housing portion as illustrated.

Extending axially inwardly through the rear housing portion 20, and through the central housing portion 24 into cavity 36, is a central axial bore 38 (FIG. 3A) which operatively receives piston means in the form of a piston assembly 40 and an elongated cylindrical piston rod 42 carried by the piston assembly for reciprocation therewith in the bore 38. Piston assembly 40 comprises interlocking front and rear annular piston members 44, 46 and an annular seal element 48 which is captively retained therebetween and slidingly seals the piston assembly 40 within the bore 38. A reduced diameter end portion 50 of the piston rod 42 is extended rearwardly through the interlocked piston members 44, 46 and outwardly through a cylindrical axial bore 52 formed in the rear piston member 46 and defining therein an annular shoulder 54. A retaining nut 56 is threaded onto the rear end 58 of the piston rod 42 and captively retains the piston 40 between the nut 56 and an annular shoulder 60 on the rod 42. Piston members 44, 46 are internally sealed to each other and to the piston rod 42 by means of O-ring seals 62 and 64.

A cylindrical plug member 66 is threaded into the rear or right end of the bore 38 and is sealed to the interior surface thereof by means of an O-ring seal 68. At its inner end the plug member 66 is provided with an inwardly projecting annular skirt 70 whose inner end 72 functions as a rearward stop for the rearwardly facing annular end surface 74 of the rear piston member 46, the piston assembly 40 being illustrated in FIG. 3A adjacent its rearward or fully retracted position within the bore 38.

Figure 3A:
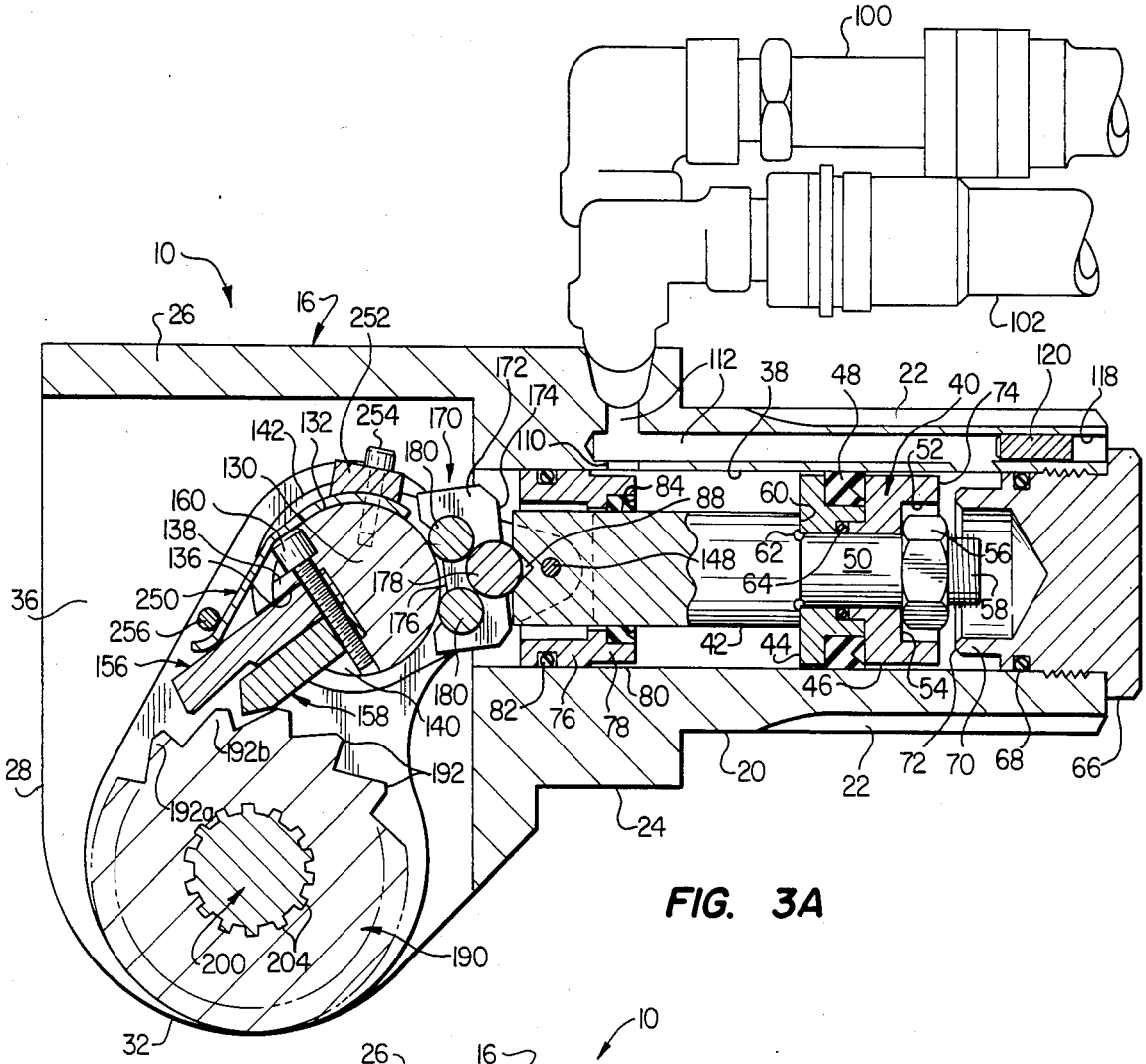
FIG. 3A is an enlarged scale cross-sectional view, partially in elevation, through the wrench, with its internal drive piston rod adjacent its fully retracted position, taken along line 3A—3A of FIG. 4.
Figure 6:
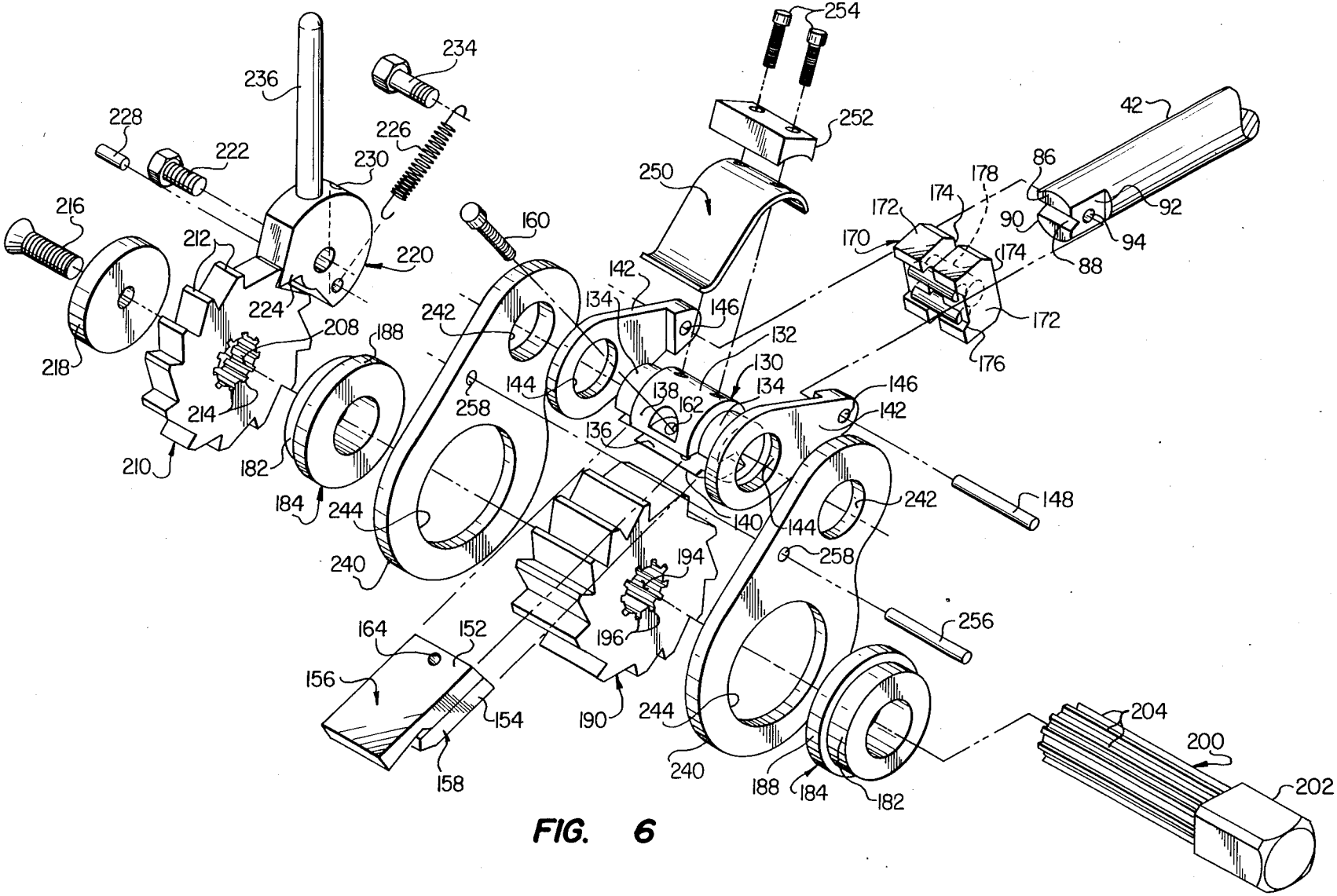
FIG. 6 is an exploded perspective view of the drive mechanism illustrated in FIG. 5.

As illustrated in FIG. 3A, the piston rod 42 extends leftwardly from the piston assembly 40 within the bore 38 and is coaxially and slidably extended through an annular guide member 76 which is press-fitted into the bore 38 adjacent its left or inner end. Guide member 76 has formed thereon a reduced diameter, rightwardly extending annular skirt portion 78 which defines with the interior surface of bore 38 a small annulus 80. Annular guide member 76 is externally sealed to the interior surface of bore 38 by means of an O-ring seal 82, and is internally sealed to the piston rod 42 by an annular sliding seal member 84 disposed within the skirt 78. As best illustrated in FIG. 6, the left or outer end surface 86 of the piston rod 42 has a notch 88 formed therein. An outer end portion of the piston rod 42 is laterally notched on opposite sides thereof to form essentially flat opposite side surfaces 90, 92 thereon which extend rearwardly from the notch 88. A small circular bore 94 is formed transversely through the rod 42 between these side surfaces 90 and 92.

Referring now to FIGS. 1 and 3A, the piston 40 and its associated piston rod 42 may selectively be caused to reciprocate within the housing bore 38 by means of the hydraulic power supply system 14 which comprises a pair of hydraulic supply conduits 100 and 102 which are respectively interconnected between the outlets 104, 106 of a hydraulic switching valve 108 and hydraulic passageways 110, 112 formed within the wrench housing 16. Pressurized hydraulic fluid from a source thereof (not illustrated) is supplied to the valve 108 through a main supply conduit 114, the valve 108 being provided with a pair of selector buttons 116, 118. Supply passageway 112 extends downwardly through a sloped, recessed upper surface portion 116 of the central housing section 24, turns horizontally rearwardly through an upper portion of the rear housing section 20, and then turns downwardly into the bore 38 between the piston 40 and the end plug 66. The horizontally extending portion of the passageway 112 is conveniently formed by extending a circular bore 118 inwardly through the rear end of housing section 20, the unused portion of the bore 118 being sealed by a suitable cylindrical plug 120 which is press-fitted into the outer end of the bore. Supply passageway 110 is extended downwardly through a sloped, recessed upper surface portion 122 of the central housing section 24 and into the small annulus 80 disposed within the bore 38. The vertically extending passageway 110 is disposed immediately behind the passageway 112 as viewed in FIG. 3A.

To drive the piston 40 leftwardly from its rearward position illustrated in FIG. 3A, the operator of the wrench depresses valve button 118 to flow pressurized hydraulic fluid, via the supply conduit 102 and the internal passageway 112, into the bore 38 between the piston 40 and the end cap 66. Hydraulic fluid entering bore 38 through the outlet of passageway 112 drives the piston 40 leftwardly toward the guide member 76 which acts as a forward stop for the piston. To return the piston rightwardly or rearwardly within the bore 38, the operator depresses valve button 116 to flow pressurized hydraulic fluid into the skirt annulus 80 via the supply conduit 100 and the vertically extending passageway 110. Hydraulic fluid entering the annulus 80 acts upon the forwardly facing annular end surface of the piston to drive it rearwardly within the bore 38 toward the rear piston stop defined by the annular end surface 72 of the plug 66.

Referring now to FIGS. 3A, 4, 5 and 6, the wrench 10 is provided with a cylindrical drive pin 130 which extends transversely between the housing sidewalls 28, 30 within the cavity 36 and is spaced forwardly from the outer end 86 of the piston rod 42. Drive pin 130 has a longitudinally central portion 132, a pair of reduced diameter opposite end portions 134, and a longitudinally extending external slot 136 formed therein. Slot 136 extends between the opposite ends of the drive pin and forms thereon a pair of upper and lower longitudinally extending lips 138 and 140.

The drive pin 130 is linked to the reduced cross-section outer end portion of the piston rod 42 by means of a pair of return link members 142. Each of the return link members 142 has a relatively wide outer end portion having a circular opening 144 formed therethrough (FIG. 6), and a relatively narrow, transversely enlarged inner end portion having a smaller circular opening 146 formed therethrough. Openings 144 pivotally receive the outer end portions 134 of the drive pin, while the inner ends of the return link members are pivotally connected to the opposite piston rod side surfaces 90 and 92 by means of a roll pin 148 which is extended through the return link end openings 146 and the opening 94 extending between the piston rod side surfaces 90, 92.

Inner end portions 152, 154 of a pair of drive pawls 156 and 158 are received in the drive pin slot 136 and are captively retained therein by means of an attachment screw 160 which extends downwardly through recessed openings 162 formed in the drive pin lips 138 and 140, and aligned openings 164 formed through the drive pawl end portions 152 and 154. Pawl 156 is somewhat longer than pawl 158 and is positioned directly above it in the drive pin position illustrated in FIG. 3A.

Interposed between and engaging the drive pin 130 and the outer end of the piston rod 42 are uniquely configured split bracket roller means 170 which, as subsequently described, provide a significantly improved interconnection between the piston means and the drive pin compared to interconnections utilized in conventional hydraulic power wrenches. The return link members 142, which are pivotally interconnected between the drive pin 130 and the piston rod 142, serve to captively retain the roller means 170 between the piston rod and the drive pin.

Split bracket roller means 170 comprise a pair of bracket body members 172 which have essentially flat rearwardly facing surfaces 174, and forwardly facing surfaces which are notched as at 176. The body members 172 have circular bores formed therein which rotatably receive opposite end portions of a rear roller 178 and a pair of front rollers 180. As best illustrated in FIG. 3A, a circumferential side surface portion of the roller 178 projects rearwardly from the bracket body surfaces 174 and is received in the piston rod end notch 88, while circumferential side surface portions of the rollers 180 project forwardly from the notched front surfaces 176 of the bracket body members 172 and rollingly engage circumferentially spaced portions of the longitudinally central portion 132 of drive pin 130.

Figure 4:
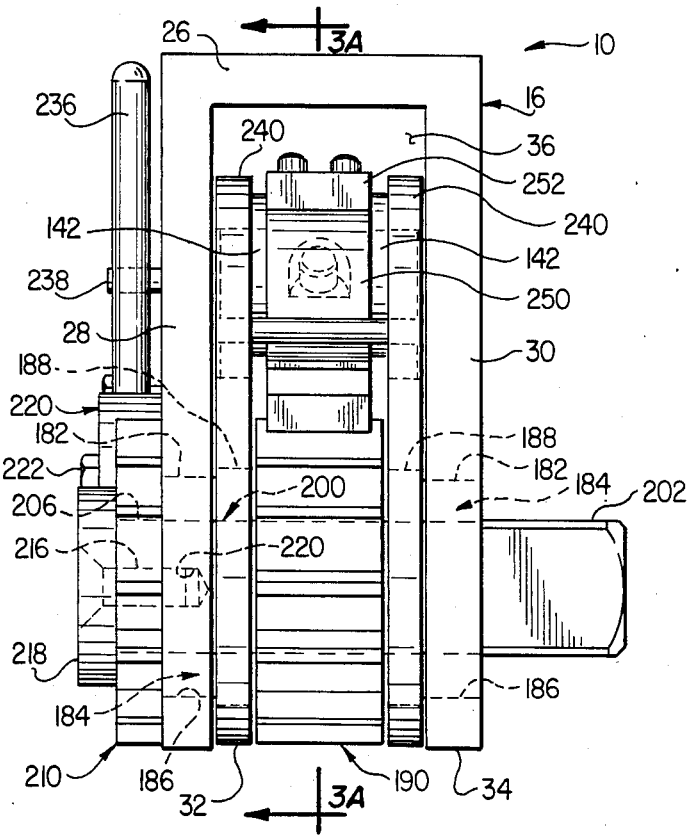
FIG. 4 is a front end elevational view of the wrench.
Figure 5:
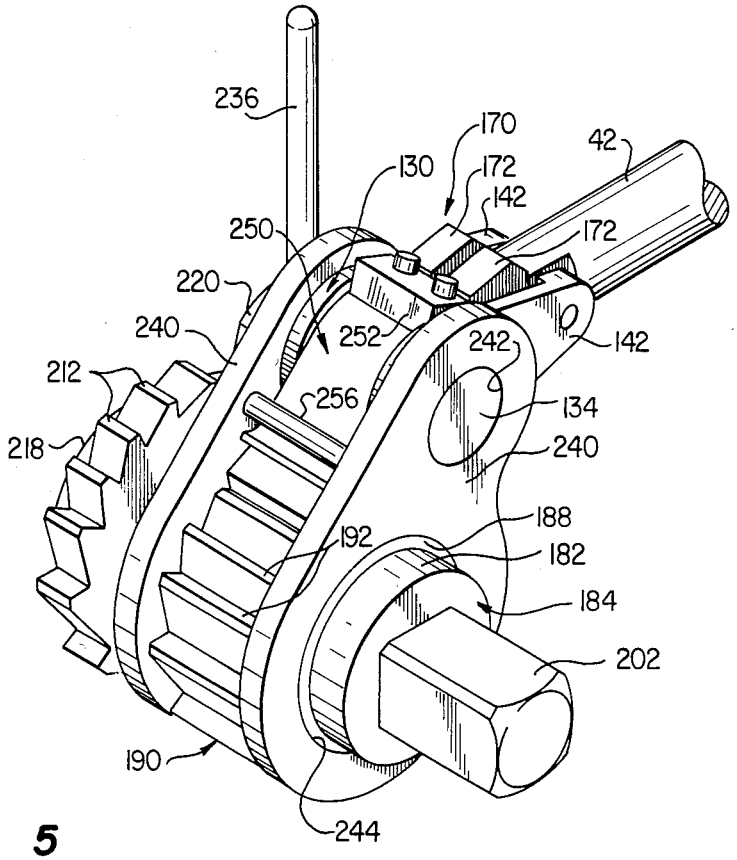
FIG. 5 is a fragmentary perspective view of the drive mechanism of the wrench.

The reduced diameter end portions 182 of a pair of annular sleeves 184 (FIG. 6) are extended outwardly through circular openings 186 (FIG. 4) formed through the housing sidewalls 28, 30 adjacent their lower ends 32 and 34, the larger diameter end portions 188 of the sleeve being positioned adjacent the inner surfaces of the sidewall 28, 30 within the housing cavity 36 as best illustrated in FIG. 4. Positioned between the sleeves 184 within the housing cavity 36 is an annular drive ratchet member 190 which has formed around its periphery a circumferentially spaced series of teeth 192. The interior surface of the central opening 194 of the ratchet member 190 has formed therein a circumferentially spaced series of axially extending grooves 196.

To transmit rotational power from the wrench 10 to the representative threaded fastener 18 (FIG. 1), the wrench is provided with an elongated drive shaft 200 (FIGS. 4 and 6) which, at its right end, has a square drive portion 202. The balance of the drive shaft 200 has a circular cross-section, and has formed thereon a circumferentially spaced series of axially extending external splines 204. The splined portion of the drive shaft 200 is inserted leftwardly through the sleeves 184 and the central opening 194 of the drive ratchet 190 so that a left end portion 206 (FIG. 5) of the shaft projects outwardly from the housing sidewall 32, and the square drive portion 202 of the shaft is positioned closely adjacent to and projects outwardly from the housing sidewall 30.

The splines 204 on the drive shaft 200 are received in the interior grooves 196 formed on the drive ratchet 190 so that the ratchet is rotationally locked to the drive shaft within the housing cavity 36. The sleeves 184 support the drive shaft 200 for rotation relative to such sleeves and the housing 16. The splined, outwardly projecting end portion 206 of the drive shaft extends through the central opening 208 in an annular safety ratchet member 210 disposed externally of the housing 16 closely adjacent the exterior surface of its sidewall 28. Safety ratchet 210 has a circumferentially spaced series of peripheral teeth 212 formed thereon, and a circumferentially spaced series of axially extending grooves 214 formed in the interior surface of its central opening 208. Grooves 14 receive the shaft splines 204 on sahft end portion 206 to thereby lock the safety ratchet 210 on the drive shaft 200 for rotation therewith relative to the housing 16. External ratchet 210 is axially retained on the drive shaft 200 by means of a retaining screw 216 which extends through a washer element 218 and is threaded into an internally threaded axial bore 220 (FIG. 4) extending inwardly through the left end of the drive shaft.

The safety ratchet member 210 defines a portion of an external safety mechanism which, as will be seen, provides the wrench 10 with unique operating advantages compared to hydraulic power wrenches of conventional construction. Such external safety mechanism also includes a safety pawl member 220 which is pivotally connected to the housing sidewall (FIGS. 2, 5 and 6) by means of a small pivot bolt 222 which extends through the pawl 220 and is threaded into a suitable opening formed in the housing sidewall 28. A front end portion 224 of the pawl 220 is pivotally biased into operative engagement with one of the pawl teeth 212 by means of a small coil spring 226. Spring 226 is connected at one end to a pin 228 carried within a recess 230 (FIG. 2) formed in the back end 232 of pawl 220, and is connected at its opposite end to a pin 234 which is threaded into a suitable opening formed in the housing sidewall 28 and is positioned rearwardly and upwardly of the pawl spring pin 228. The safety pawl 220 may be pivoted out of operative engagement with the safety ratchet 210 by means of a lever 236 which is secured at its lower end to the safety pawl 220 and projects upwardly therefrom. Rearward pivotal motion of the lever 236 is limited by a small stop pin 238 FIGS. 2 and 4 threaded into an appropriate opening formed in the housing sidewall 28.

Returning again to the interior of the housing, the internal drive mechanism of the wrench 10 includes a pair of outboard drive bracket members 240 (FIGS. 4–6) each having a relatively narrow upper end portion having a circular opening 242 formed therethrough, and a relatively wide outer end portion having a larger circular opening 244 formed therethrough. The upper bracket openings 242 rotatably receive the reduced diameter end portions 134 of the drive pin 130, while the bracket openings 244 rotatably receive the larger diameter end portions 188 of the housing sleeves 184. As best illustrated in FIG. 4, the upper ends of the drive brackets 240 are sandwiched between the return link members 142 and the interior surfaces of the housing sidewalls 28 and 30, while the lower ends of the drive brackets are sandwiched between the interior sidewall surfaces and the drive ratchet 190. The drive brackets 240 are accordingly pivotally interconnected between the drive pin 130 and, via the sleeves 184, the drive shaft 200.

The outer ends of the drive pawls 156, 158 are pivotally biased into engagement with the drive ratchet 190 by means of an elongated leaf spring 250 (FIGS. 3A, 4 and 5) A first end portion of the spring 250 is fixedly secured to the longitudinally central portion 132 of the drive pin 130 by means of a clamping block 252 and a pair of retaining screws 254 which are extended downwardly through the clamping block 252, through the spring 250 and into suitable radially extending threaded openings formed in the drive pin. An opposite end portion of the spring 250 passes under and slidably engages a pin 256 whose opposite end portions are retained in circular openings 258 (FIG. 6) formed through the outboard drive brackets 240.

To brace the wrench 10 during operation thereof in a manner subsequently described, the wrench is provided with the uniquely configured reaction arm member 18 (FIGS. 1 and 2) which is removably connectable to the wrench housing in a multiplicity of rotational orientations relative thereto. The reaction arm member 18 comprises a hollow cylindrical body portion 262 and a generally L-shaped reaction arm 264 formed integrally therewith and projecting transversely outwardly therefrom. The cylindrical interior surface of the body 262 has formed therein a circumferentially spaced series of axially extending grooves 266. To attach the reaction arm member 18 to the housing 16, the rear housing portion 20 is coaxially inserted into the hollow reaction arm body 262 so that the housing splines 22 interlock with the body grooves 266. The interlock between the splines 22 and the grooves 266 positively locks the reaction arm member 18 against rotation relative to the housing end portion 20 in either direction about its axis. Axial dislodgment of the body 262 from the housing end portion 20 is conveniently prevented by means of a small set screw 268 which extends radially inwardly through the reaction arm body 262 and bears against the housing end portion 20 along a forward end section thereof.

It is important to note that the spline and groove attachment of the reaction arm member 18 to the rear housing section 20 not only prevents rotation of the reaction arm member in either direction about the housing section 20, but also permits the reaction arm member to be quickly removed and reconnected in a multiplicity of rotational orientation relative to the housing 16. As an example, if there are twenty splines 22 formed on the rear housing section 20, the reaction arm member 18 may be installed thereon in twenty different orientations. As will be seen, this aspect of the present invention significantly enhances the usefulness and operational flexibility of the wrench 10.

The unique operation and advantages of the wrench 10 will now be described with reference to FIG. 3A in which the positions of the internal drive components of the wrench are those assumed when the piston means 40 are adjacent the rearward end of their stroke. With the reaction arm member 18 connected to the rear housing section 20 in a predetermined one of the reaction arm member's many available relative positions, the square drive end portion 202 of the drive shaft 200 (FIG. 1) is snapped into the inner end of a suitable adapter socket 270. The outer end of the socket 270 is then slipped over the head of the bolt 12 which is to be tightened, and the reaction arm 264 (FIG. 2) is braced against a suitable stationary support surface such as the head of a bolt 272 near the bolt 12. The operator of the wrench then depresses the valve button 118 to drive the piston 40 and the piston rod 42 leftwardly in the housing bore 38 as previously described.

The leftward force on the piston rod 42 is very smoothly transmitted to the drive pin 130 through the split bracket roller means 170 which are pivotally connected to the rod 42 (via the rear roller 178 received in rod notch 88) and rollingly engage the drive pin (via the front rollers 180). Leftward movement of the drive pin 130 causes the return link members 142 to pivot slightly in a clockwise direction about the roll pin 148 while slightly lifting the drive pin 130, and also pivots the outboard drive bracket members 240 in a counterclockwise direction about the drive shaft 200.

During such leftward translation of the drive pin 130, the biasing force of the leaf spring 250 automatically causes the drive pin 130 to be rotated in a counterclockwise direction to thereby pivot the drive pawls 156, 158 into respective operative engagement with two of the teeth $192_a$ and $192_b$ of the internal drive ratchet 190. It should be noted that the spring 250 biases the drive pawls into engagement with these teeth without actually contacting the drive pawls. Since, during the forward driving stroke of the piston means 40, the spring 250 is maintained in a spaced relationship from the pawl-tooth interengagement area, the possibility that the biasing spring would interfere with this interengagement is substantially eliminated.

Figure 3B:
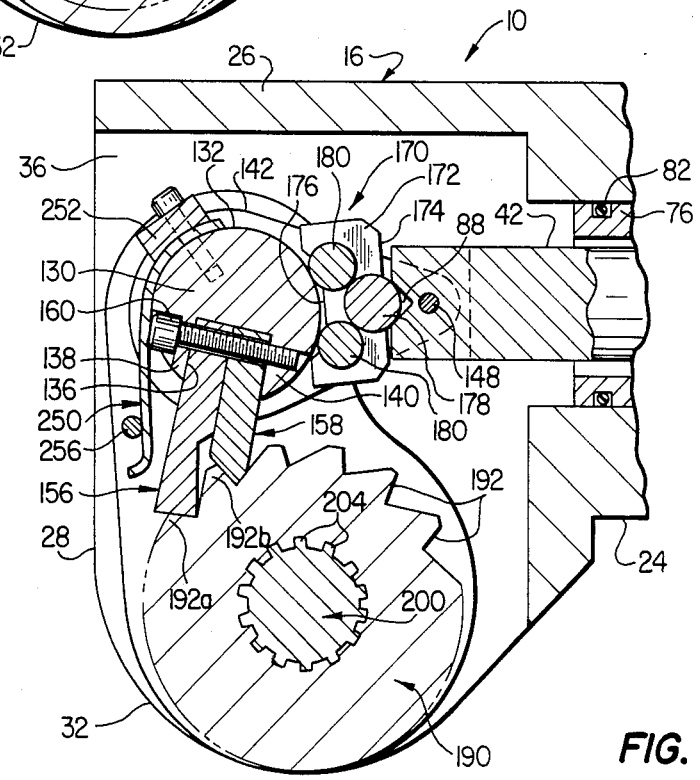
FIG. 3B is a fragmentary cross-sectional view similar to FIG. 3A, but with the drive piston rod adjacent its fully extended position.

When the piston rod 42 has been driven to the leftward limit of its power stroke, the internal drive components of the wrench 10 have been moved to the positions indicated in FIG. 3B, and the drive pawls 156, 158 have incrementally rotated the internal drive ratchet 190 in a counterclockwise direction as indicated by the dashed arrow 274 in FIG. 1. The extent of this limited incremental rotation may easily be seen by comparing the positions of driven ratchet teeth $192_a$, $192_b$ in FIGS. 3A and 3B. The counterclockwise rotation of the drive ratchet 190 also rotationally drives the square drive portion 202 to incrementally tighten the bolt 12. Reactive rotation in a clockwise direction about the axis of the drive shaft 200 is prevented by the reaction arm 264 which is braced against the adjacent bolt 272 (FIG. 2). Counterclockwise rotation of the drive rachet 210 and the drive shaft 200 also causes an incremental counterclockwise rotation of the external safety ratchet 210 which pivots the safety pawl 220 out of operative engagement with the safety ratchet teeth 212.

When the piston rod 42 has reached the leftward limit of its forward or power stroke, the wrench operator depresses the valve button 116 to move the piston means 40 through their rightward or return stroke as previously described. During this return stroke the drive pin 130 is pulled rightwardly by the return links 142 and is automatically caused to rotate in a clockwise direction against the biasing force of the leaf spring 250 to thereby pivot the drive pawls 156, 158 out of operative engagement with the drive ratchet teeth 192. However, clockwise rotation of the drive ratchet 190, the drive shaft 200, and the square drive portion 202 is precluded by the engagement of the external safety pawl 220 with one of the safety ratchet teeth 212.

This drive and return stroke cycle is repeated by the wrench operator until the predetermined maximum wind-up force on the bolt 12 is reached. The maximum wind-up force on the bolt may, of course, be preselected by adjusting the hydraulic supply pressure to the wrench 10. The unique external positioning of the safety ratchet and pawl mechanism advantageously solves a longstanding problem commonly associated with hydraulic power wrenches of conventional design. Specifically, it is a frequent occurrence in such conventional power wrenches that the maximum wind-up force is reached when the internal drive piston is in some intermediate position of its power stroke. This results in the bracing portion of the wrench housing being frictionally locked to the adjacent stationary support surface, rendering it difficult to remove from such supporting surface and the threaded fastener which has just been tightened. This is due to the fact that the safety ratchet and pawl mechanism (or other safety mechanisms which prevent reverse rotation of the drive shaft) in conventional hydraulic power wrenches are inaccessably disposed within their housings. Accordingly, there is no convenient method for releasing such safety mechanisms from outside the wrench housing.

This is simply not a problem in the wrench 10. If the maximum fastener wind-up force is reached when the piston means 40 are somewhere in forward mid-stroke, the safety pawl lever 236 is simply manually pivoted rearwardly against the biasing force of spring 226 to withdraw the safety pawl 220 for operative engagement with the safety ratchet 210. This conveniently permits the wrench housing 16 to be pivoted in a counterclockwise direction (as viewed in FIG. 1) about the drive shaft 200 (without loosening the tightened bolt 12) to free the reaction arm 264 from engagement with the adjacent bolt 272 (FIG. 2). This, in turn, permits the wrench 10 to be rapidly disengaged from the tightened bolt 12 and moved to another bolt which needs to be tightened.

In addition to the operational advantages accorded the wrench 10 by virtue of the uniquely adjustable reaction arm member 18 and the external safety pawl and ratchet mechanism, the incorporation in the wrench 10 of the specially designed split roller bracket assembly 170 also uniquely solves a rather critical problem associated with hydraulic power wrenchs of conventional design—namely, the premature failure and/or excessive wear of drive components in the piston rod-drive pin interface area. This area is traditionally the "weak link" in the internal drive mechanism of conventional hydraulic power wrenches. In the wrench 10, however, it has been found that the split roller bracket assembly 170 is not subject to breakage as in the case of small linkage pins used to make this piston-drive pin connection, does not cause galling of the drive pin, and significantly reduces the frictional contact forces on the drive pin. Because of these desirable features associated with the split roller block assembly 170, the overall durability of the internal drive system within the wrench 10 is significantly increased, thereby concomitantly decreasing its operational downtime and the repair expense associated therewith.

It can be seen in FIG. 1 that the wrench 10 assembled as previously described, functions only as a fastener-tightening tool due to the counterclockwise rotation of the square drive portion 202 of the drive shaft 200. However, the wrench 10 may be quickly and easily converted to a fastener-loosening tool simply by removing the retaining screw 216 (FIG. 6) from the left end of the drive shaft 200, pulling the drive shaft outwardly through the housing sidewall 30, and reinserting the shaft through the housing sidewall 28 so that the square drive portion 202 is adjacent the sidewall 28 and the end portion 206 of the shaft projects outwardly through the housing sidewall 30. The safety ratchet 210 may then be slipped into the re-oriented shaft end portion 206, and the screw 216 and washer 218 connected to the shaft. In a similar manner, the balance of the external safety release mechanism (namely the safety pawl 220, the biasing spring 226 and the threaded members 222, 234 and 238) may be removed and reinstalled on the right side of the housing as viewed in FIG. 1. To facilitate this reoriented installation, suitable threaded openings $222_a$, $234_a$ and $238_a$ are formed in the right side of the housing to respectively receive the threaded elements 222, 234, and 238. Reversed end-for-end in this manner, the drive shaft 200, when rotated in a counterclockwise direction, will function to loosen conventionally threaded fasteners.

It can be seen from the foregoing that the present invention provides a substantially improved hydraulic power wrench which has significantly increased operational flexibility and structural durability.

The foregoing detailed description is to be clearly understood as given by way of illustration and example only, the spirit and scope of the present invention being limited solely by the appended claims.

What is claimed is:

1. Power wrench apparatus comprising:
(a) housing means having a chamber therein;
(b) piston means disposed in said chamber for reciprocating motion therein between first and second positions;
(c) means for utilizing fluid power to selectively cause reciprocating motion of said piston means in said chamber;
(d) drive pin means spaced from said piston means;
(e) roller means interposed between and engaging facing surface portions of said piston means and said drive pin means, said roller means comprising:
roller bracket means;
a first roller member captively retained in said roller bracket means for rotation relative thereto and having a side surface portion which engages a surface portion of said piston means; and
second and third roller members captively retained in said roller bracket means for rotation relative thereto and having side surface portions which engage said drive pin means on circumferentially spaced side surface portions thereof;
(f) return link means pivotally interconnected between said piston means and said drive pin means and captively retaining said roller means between said piston means and said drive pin means;
(g) drive shaft means, associated with said housing means for driven rotation relative thereto, for transmitting rotational power;
(h) drive ratchet means rotationally locked to said drive shaft means and positioned within said housing means;
(i) drive bracket means pivotally interconnected between said drive pin means and said drive shaft means;
(j) drive pawl means, carried by said drive pin means, for engaging and incrementally driving said drive ratchet means in a first rotational direction during motion of said piston means toward said first position thereof;
(k) means for biasing said drive pawl means into engagement with said drive ratchet means; and
(l) safety pawl and ratchet means for preventing rotation of said drive shaft means relative to said housing means in a second rotational direction opposite from said first rotational direction during motion of said piston means toward said second position thereof.

2. The apparatus of claim 1 wherein:
said piston means include a piston rod having an axially inset outer end surface portion which receives a side portion of said first roller member.

3. The apparatus of claim 2 wherein:
said return link means are pivotally connected to said piston rod adjacent said outer end surface portion thereof.

4. The apparatus of claim 2 wherein:
said drive pawl means are fixedly secured to said drive pin means for rotation therewith.

5. The apparatus of claim 4 wherein:
said drive pin means have an axially extending side surface slot formed therein; and
said drive pawl means have an inner end portion received in said slot.

6. Power wrench apparatus comprising:
(a) housing means having a chamber therein;
(b) piston means disposed in said chamber for reciprocating motion therein between first and second positions;
(c) means for utilizing fluid power to selectively cause reciprocating motion of said piston means in said chamber;
(d) drive pin means spaced from said piston means;
(e) roller means interposed between and engaging facing surface portions of said piston means and said drive pin means;
(f) return link means pivotally interconnected between said piston means and said drive pin means and captively retaining said roller means between said piston means and said drive pin means;
(g) drive shaft means, associated with said housing means for driven rotation relative thereto, for transmitting rotational power;
(h) drive ratchet means rotationally locked to said drive shaft means and positioned within said housing means;
(i) drive bracket means pivotally interconnected between said drive pin means and said drive shaft means;
(j) drive pawl means, carried by said drive pin means, for engaging and incrementally driving said drive ratchet means in a first rotational direction during motion of said piston means toward said first position thereof;
(k) means for biasing said drive pawl means into engagement with said drive ratchet means;

(l) safety pawl and ratchet means for preventing rotation of said drive shaft means relative to said housing means in a second rotational direction opposite from said first rotational direction during motion of said piston means toward said second position thereof; and (m) fastener means extending through said drive pin means and said inner end portion of said drive pawl means, and captively retaining said inner end portion of said drive pawl means in said slot, said drive pin means having an axially extending side surface slot formed therein, and said drive pawl means being fixedly secured to said drive pin means for rotation therewith and having an inner end portion received in said slot.

7. The apparatus of claim 6 wherein:

said drive pawl means include first and second drive pawl members having unequal lengths.

8. Power wrench apparatus comprising:

(a) housing means having a chamber therein;

(b) piston means disposed in said chamber for reciprocating motion therein between first and second positions;

(c) means for utilizing fluid power to selectively cause reciprocating motion of said piston means in said chamber;

(d) drive pin means spaced from said piston means;

(e) roller means interposed between and engaging facing surface portions of said piston means and said drive pin means;

(f) return link means pivotally interconnected between said piston means and said drive pin means and captively retaining said roller means between said piston means and said drive pin means;

(g) drive shaft means, associated with said housing means for driven rotation relative thereto, for transmitting rotational power;

(h) drive ratchet means rotationally locked to said drive shaft means and positioned within said housing means;

(i) drive bracket means pivotally interconnected between said drive pin means and said drive shaft means;

(j) drive pawl means, carried by said drive pin means, for engaging and incrementally driving said drive ratchet means in a first rotational direction during motion of said piston means toward said first position thereof;

(k) means for biasing said drive pawl means into engagement with said drive ratchet means, said means for biasing including spring means interconnected between said drive pin means and said drive bracket means; and (l) safety pawl and ratchet means for preventing rotation of said drive shaft means relative to said housing means in a second rotational direction opposite from said first rotational direction during motion of said piston means toward said second position thereof.

9. The apparatus of claim 8 wherein:

said apparatus further comprises a pin carried by said drive bracket means; and said spring means include an elongated leaf spring member having a first end portion fixedly secured to said drive pin means, and a second end portion slidably engaging said pin carried by said drive bracket means.

10. Power wrench apparatus comprising:

(a) housing means having a chamber therein;

(b) piston means disposed in said chamber for reciprocating motion therein between first and second positions;

(c) means for utilizing fluid power to selectively cause reciprocating motion of said piston means in said chamber;

(d) drive pin means spaced from said piston means;

(e) roller means interposed between and engaging facing surface portions of said piston means and said drive pin means;

(f) return link means pivotally interconnected between said piston means and said drive pin means and captively retaining said collar means between said piston means and said drive pin means;

(g) drive shaft means, associated with said housing means for driven rotation relative thereto, for transmitting rotational power;

(h) drive ratchet means rotationally locked to said drive shaft means and positioned within said housing means;

(i) drive bracket means pivotally interconnected between said drive pin means and said drive shaft means;

(j) drive pawl means, carried by said drive pin means, for engaging and incrementally driving said drive ratchet means in a first rotational direction during motion of said piston means toward said first position thereof;

(k) means for biasing said drive pawl means into engagement with said drive ratchet means;

(l) safety pawl and ratchet means for preventing rotation of said drive shaft means relative to said housing means in a second rotational direction opposite from said first rotational direction during motion of said piston means toward said second position thereof; and (m) means, external to said housing, for selectively rendering said safety pawl and ratchet means temporarily inoperative to thereby permit rotation of said drive shaft means relative to said housing means in said second rotational direction.

11. The apparatus of claim 10 wherein said safety pawl and ratchet means comprise:

a safety ratchet member rotationally locked to said drive shaft means and disposed externally of said housing means;

a safety pawl member disposed externally of said housing means and pivotally connected thereto; and safety spring means for biasing said safety pawl member into engagement with said safety ratchet member.

12. The apparatus of claim 11 wherein said safety spring means comprise:

a spring member interconnected between said safety pawl member and said housing means.

13. The apparatus of claim 12 wherein:

said means for selectively rendering said safety pawl and ratchet means temporarily inoperative include lever means, connected to said safety pawl member, for pivoting said safety pawl member out of operative engagement with said safety ratchet member against the biasing force of said safety spring means.

14. Power wrench apparatus comprising:

(a) housing means having a chamber therein;

(b) piston means disposed in said chamber for reciprocating motion therein between first and second positions;

(c) means for utilizing fluid power to selectively cause reciprocating motion of said piston means in said chamber;

(d) drive pin means spaced from said piston means;

(e) roller means interposed between and engaging facing surface portions of said piston means and said drive pin means;

(f) return link means pivotally interconnected between said piston means and said drive pin means and captively retaining said roller means between said piston means and said drive pin means;

(g) drive shaft means, associated with said housing means for driven rotation relative thereto, for transmitting rotational power, said housing means having a support portion extending generally transversely to said drive shaft means;

(h) drive ratchet means rotationally locked to said drive shaft means and positioned within said housing means;

(i) drive bracket means pivotally interconnected between said drive pin means and said drive shaft means;

(j) drive pawl means, carried by said drive pin means, for engaging and incrementally driving said drive ratchet means in a first rotational direction during motion of said piston means toward said first position thereof;

(k) means for biasing said drive pawl means into engagement with said drive ratchet means;

(l) safety pawl and ratchet means for preventing rotation of said drive shaft means relative to said housing means in a second rotational direction opposite from said first rotational direction during motion of said piston means toward said second position thereof;

(m) a reaction arm braceable against a support surface; and (n) means for releasably and transversely securing said reaction arm to said support portion of said housing means in a multiplicity of angular orientations relative to the longitudinal axis of said drive shaft means in which movement of said reaction arm relative to said housing means is precluded.

15. The apparatus of claim 14 wherein:

said support portion of said housing means is generally cylindrical; and said means for releasably and transversely securing comprise a body secured to an end portion of said reaction arm and having a cylindrical opening extending therethrough generally transversely to said reaction arm and adapted to coaxially receive said support portion of said housing means, a circumferentially spaced series of axially extending external splines on said support portion of said housing means, and a circumferentially spaced series of axially extending internal grooves positioned within said opening in said body and adapted to receive said splines.

16. Power wrench apparatus comprising:

(a) housing means having a chamber therein;

(b) piston means disposed in said chamber for reciprocating motion therein between first and second positions;

(c) means for utilizing fluid power to selectively cause reciprocating motion of said piston means in said chamber;

(d) drive shaft means, having an axis and being associated with said housing means for driven rotation relative thereto about said axis, for transmitting rotational power;

(e) linkage means disposed within said housing means and pivotally interconnected between said piston means and said drive shaft means;

(f) drive ratchet means disposed within said housing and rotationally locked to said drive shaft means;

(g) drive pawl means, carried by said linkage means, for driving said drive ratchet means in a first rotational direction relative to said axis during movement of said piston means toward said first position thereof;

(h) safety means for preventing rotation of said drive ratchet means about said axis in a second rotational direction opposite from said first rotational direction; and (i) manually operable means, external to said housing means, for selectively rendering said safety means temporarily inoperative to thereby permit rotation of said drive ratchet means relative to said housing in said second rotational direction.

17. The apparatus of claim 16 wherein said safety means comprise:

a safety ratchet member disposed externally of said housing means and rotationally locked to said drive shaft means;

a safety pawl member pivotally connected to the exterior of said housing means; and means biasing said safety pawl member into engagement with said safety ratchet member.

18. The apparatus of claim 17 wherein:

said means biasing said safety pawl member comprise spring means interconnected between said safety pawl member and the exterior of said housing means.

19. The apparatus of claim 18 wherein:

said manually operable means comprise means connected to said safety pawl member for facilitating manual pivoting thereof out of operative engagement with said safety ratchet member against the biasing force of said spring means.

20. Hydraulic power wrench apparatus comprising:

(a) a housing;

(b) a rod disposed within said housing and having first and second opposite ends and a longitudinal axis;

(c) means for utilizing hydraulic power to cause axial reciprocation of said rod between first and second positions;

(d) a drive pin disposed within said housing, said drive pin being transverse to said rod and spaced apart from said first end portion thereof;

(e) roller means interposed between said first end of said rod and said drive pin, said roller means engaging said first end of said rod and circumferentially spaced side surface portions of said drive pin;

(f) a drive shaft extending through said housing transversely to said rod and being rotatable relative to said housing;

(g) linkage means pivotally interconnected between said drive pin and said drive shaft;

(h) means, pivotally interconnected between said rod and said drive pin, for captively retaining said roller means between said drive pin and said first end of said rod;

(i) interengageable means on said drive pin and said drive shaft for causing rotation of said drive shaft in a first direction relative to said housing in response to movement of said rod toward said first position thereof;

(j) safety means, external to said housing, for preventing rotation of said drive shaft relative to said housing in a second direction opposite from said first direction; and (k) selectively operable means, external to said safety means inoperative.

21. Hydraulic power wrench apparatus comprising:

(a) a housing;

(b) a rod disposed within said housing and having first and second opposite ends and a longitudinal axis;

(c) means for utilizing hydraulic power to cause axial reciprocation of said rod between first and second positions;

(d) a drive pin disposed within said housing, said drive pin being transverse to said rod and spaced apart from said first end portion thereof;

(e) roller means interposed between said first end of said rod and said drive pin, said roller means engaging said first end of said rod and circumferentially spaced side surface portions of said drive pin;

(f) a drive shaft extending through said housing transversely to said rod and being rotatable relative to said housing;

(g) linkage means pivotally interconnected between said drive pin and said drive shaft;

(h) means, pivotally interconnected between said rod and said drive pin, for captively retaining said roller means between said drive pin and said first end of said rod;

(i) interengageable means on said drive pin and said drive shaft for causing rotation of said drive shaft in a first direction relative to said housing in response to movement of said rod toward said first position thereof, said interengageable means comprising a drive pawl fixedly secured to said drive pin for rotation therewith, and a drive ratchet rotationally locked to said drive shaft within said housing;

said apparatus further comprising a second pin carried by said linkage means between said drive shaft and said drive pin, and a leaf spring having a first end portion fixedly secured to said drive pin and a second end portion slidably engaging said second pin, and leaf spring biasing said drive pawl into engagement with said drive ratchet without contacting said drive pawl.

22. The apparatus of claim 21 wherein said safety means comprise:

a safety ratchet rotationally locked to said drive shaft;

a safety pawl pivotally connected to said housing; and spring means, interconnected between said safety pawl and said housing, for pivotally biasing said safety pawl into operative engagement with said safety ratchet.

23. The apparatus of claim 22 wherein said selectively operable means comprise:

a lever connected to said safety pawl.

24. Hydraulic power wrench apparatus comprising:

(a) a housing;

(b) a rod disposed within said housing and having first and second opposite ends and a longitudinal axis;

(c) means for utilizing hydraulic power to cause axial reciprocation of said rod between first and second positions;

(d) a drive pin disposed within said housing, said drive pin being transverse to said rod and spaced apart from said first end portion thereof;

(e) roller means interposed between said first end of said rod and said drive pin, said roller means engaging said first end of said rod and circumferentially spaced side surface portions of said drive pin;

(f) a drive shaft extending through said housing transversely to said rod and being rotatable relative to said housing;

(g) linkage means pivotally interconnected between said drive pin and said drive shaft;

(h) means, pivotally interconnected between said rod and said drive pin, for captively retaining said roller means between said drive pin and said first end of said rod;

(i) interengageable means on said drive pin and said drive shaft for causing rotation of said drive shaft in a first direction relative to said housing in response to movement of said rod toward said first position thereof;

(j) a reaction member projecting transversely to a portion of said housing and being braceable against a support surface to prevent rotation of said housing during use of said apparatus; and (k) spline means for releasably interconnecting said reaction member and said portion of said housing and permitting said reaction member to be connected to said portion of said housing in a multiplicity of rotational orientations relative thereto, in each of said rotational orientations said reaction member being rotationally locked to said portion of said housing by said spline means.

25. Power wrench apparatus comprising:

(a) housing means having a chamber therein;

(b) piston means disposed in said chamber and being translationally drivable between first and second positions therein;

(c) shaft means, rotatable relative to said housing means, for transmitting rotational power to a threaded fastener;

(d) ratchet means associated with said shaft means and being drivable to rotate said shaft means;

(e) rotatable drive pin means;

(f) roller means interposed between and engaging facing surfaces of said piston means and said drive pin means, said roller means pivotally engaging said piston means and rollingly engaging said drive pin means;

(g) pawl means fixedly secured to said drive pin means for rotation therewith;

(h) movable linkage means, interconnecting said drive pin means with said piston means and said shaft means, for associating said drive pin means with said piston means for translational movement therewith, for rotatably supporting said drive pin means, and for captively retaining said roller means between said piston means and said drive pin means; and (i) leaf spring means, interconnected between said drive pin means and said linkage means, for biasing said pawl means into engagement with said ratchet means, without contact between said leaf spring means and said pawl means, to thereby cause said pawl means to incrementally rotate said shaft means in a first rotational direction in response to motion of said piston means toward said first position thereof.

26. The apparatus of claim 25 wherein:

said shaft means are externally splined and have an end portion extending outwardly of said housing means;

said ratchet means comprise an annular, internally grooved drive ratchet member circumscribing and rotationally locked to said shaft means within said housing means; and said apparatus further comprises an annular, internally grooved safety ratchet member circumscribing and rotationally locked to said end portion of said shaft means, a safety pawl member pivotally connected to the exterior of said housing means, and means biasing said safety pawl member into operative engagement with said safety ratchet member to prevent rotation of said shaft means in a second rotational direction opposite from said first rotational direction, said safety pawl member being manually pivotable out of operative engagement with said safety ratchet member to thereby selectively permit rotation of said shaft means in said second rotational direction relative to said housing means.

27. Power wrench apparatus comprising:

a housing having a chamber therein;

a piston disposed in said chamber for reciprocating motion therein forwardly to a first position and rearwardly to a second position;

means for utilizing fluid power from a source thereof to selectively cause said reciprocating motion of said piston in said chamber;

a piston rod secured at an inner end thereof to said piston, extending forwardly therefrom, and having an outer end;

a drive pin positioned within said housing, extending transversely to said piston rod, and positioned forwardly of said outer end of said piston rod;

a roller bracket member interposed between said drive pin and said outer end of said piston rod;

a first roller pin member captively carried by said roller bracket member for rotation relative thereto and having an exposed side surface portion engaging said outer end of said piston rod;

laterally spaced second and third roller pin members captively carried by said roller bracket member for rotation relative thereto, said second and third roller pin members having exposed side surface portions engaging circumferentially spaced exterior side surface portions of said drive pin;

a pair of return link members having first end portions pivotally connected to opposite end portions of said drive pin, and second end portions pivotally connected to opposite sides of said piston rod adjacent said outer end thereof, said return link members pivotally interconnecting said drive pin and said piston rod, straddling said roller bracket member, and captively retaining said roller bracket member between said drive pin and said outer end of said piston rod in a manner maintaining said first roller pin member, and said second and third roller pin members, in operative engagement with said outer end of said piston rod and said drive pin, respectively;

a drive shaft, carried by said housing for driven rotation relative thereto, for transmitting rotational power;

a drive ratchet structure rotationally locked to said drive shaft and positioned within said housing;

first and second drive bracket members having first end portions pivotally connected to opposite end portions of said drive pin, and second end portions pivotally connected to said drive shaft;

a drive pawl structure, carried by said drive pin for rotation therewith relative to said first end portions of said first and second drive bracket members, for engaging and incrementally driving said drive ratchet structure in a first rotational direction during forward motion of said piston toward said first position thereof;

means for rotationally biasing said drive pin to bias said drive pawl structure into driving engagement with said drive ratchet structure;

a safety ratchet structure rotationally locked to said drive shaft and positioned externally of said housing; and a safety pawl structure externally mounted on said housing and biased into operative engagement with said safety ratchet structure to prevent rotation of said drive shaft relative to said housing in a second rotational direction opposite from said first rotational direction opposite from said first rotational direction during rearward motion of said piston toward said second position thereof.

* * * * *